US005625999A

United States Patent [19]

Buzza et al.

[11] Patent Number: 5,625,999

[45] Date of Patent: May 6, 1997

[54] FIBERGLASS SANDWICH PANEL

[75] Inventors: David W. Buzza, Mobile; Frederick W. Schoen, Fairhope; Harold P. Lovelace, Saraland, all of Ala.

[73] Assignee: International Paper Company, Purchase, N.Y.

[21] Appl. No.: 294,523

[22] Filed: Aug. 23, 1994

[51] Int. Cl.[6] ..... E04C 2/36

[52] U.S. Cl. ..... 52/793.11; 52/309.9; 52/309.11; 52/309.14; 52/574; 52/611

[58] Field of Search ..... 52/309.4, 309.9, 52/309.13, 309.14, 394, 483.1, 574, 611, 794.1, 309.11, 793.11

[56] References Cited

U.S. PATENT DOCUMENTS

| | | | |
|---|---|---|---|
| Re. 30,984 | 6/1982 | Hipchen et al. . | |
| 511,497 | 12/1893 | Blaine . | |
| 564,205 | 7/1896 | Liebau . | |
| 621,100 | 3/1899 | Knowles . | |
| 1,575,842 | 3/1926 | Johnston . | |
| 1,584,148 | 5/1926 | Schumacher . | |
| 1,842,828 | 1/1932 | Giuliani | 52/574 X |
| 1,983,410 | 12/1934 | Shryock | 52/574 X |
| 2,140,226 | 12/1938 | Harrap . | |
| 2,381,635 | 8/1945 | Baker . | |
| 2,896,271 | 7/1959 | Kloote et al. . | |
| 3,301,147 | 1/1967 | Clayton et al. . | |
| 3,385,183 | 5/1968 | Kortz . | |
| 3,615,969 | 10/1971 | Hegg | 156/78 |
| 3,704,564 | 12/1972 | Koga | 52/309.4 X |
| 3,777,430 | 12/1973 | Tischuk | 52/309.9 |
| 3,841,958 | 10/1974 | Delorme . | |
| 3,874,980 | 4/1975 | Richards et al. . | |
| 3,913,292 | 10/1975 | Braekkan | 52/574 X |
| 3,920,871 | 11/1975 | Johnson | 52/309.4 X |
| 3,926,714 | 12/1975 | Der Marderosian et al. . | |
| 3,930,917 | 1/1976 | Esakov et al. . | |
| 3,971,181 | 7/1976 | Zetlin . | |
| 4,011,022 | 3/1977 | Welty . | |
| 4,028,158 | 6/1977 | Hipchen et al. . | |
| 4,073,997 | 2/1978 | Richards et al. . | |
| 4,279,958 | 7/1981 | Ahmad . | |
| 4,284,683 | 8/1981 | Hipchen et al. . | |
| 4,288,951 | 9/1981 | Carlson et al. . | |
| 4,320,605 | 3/1982 | Carlson et al. . | |
| 4,346,133 | 8/1982 | Hipchen et al. . | |
| 4,351,138 | 9/1982 | McMillan et al. . | |
| 4,388,366 | 6/1983 | Rosato et al. . | |
| 4,418,108 | 11/1983 | Lin . | |
| 4,438,166 | 3/1984 | Gluck et al. . | |
| 4,555,418 | 11/1985 | Snider et al. . | |
| 4,575,981 | 3/1986 | Porter | 52/309.9 |
| 4,662,777 | 5/1987 | Newton | 52/309.11 X |
| 4,725,471 | 2/1988 | Imhoff | 52/309.11 X |
| 4,774,794 | 10/1988 | Grieb . | |
| 5,218,176 | 6/1993 | Meyer, Jr. | 181/199 |
| 5,305,568 | 4/1994 | Beckerman . | |
| 5,344,700 | 9/1994 | McGath et al. | 428/304.4 |
| 5,373,678 | 12/1994 | Hesser | 52/483.1 X |

FOREIGN PATENT DOCUMENTS

| | | | |
|---|---|---|---|
| 1443172 | 5/1966 | France | 52/309.4 |

*Primary Examiner*—Carl D. Friedman
*Assistant Examiner*—Kevin D. Wilkens
*Attorney, Agent, or Firm*—Ostrager, Chong & Flaherty

[57] ABSTRACT

A roofing system that provides a safe, long lasting, leak-free and maintenance-free insulated roof for flat roof applications. More particularly, a sandwich panel comprises an inner foam core, a fiberglass skin fully encapsulating and surrounding the core, and a gel coating surrounding the skin. The panel has two substantially parallel surfaces and a peripheral edge having a step edge. A plurality of panels having two different shapes and relative dimensions are alternately secured to purlins to form the roofing system so that half of the panels can be easily removed without affecting the rest of the roof.

14 Claims, 9 Drawing Sheets

FIBERGLASS SANDWICH PANEL

FIELD OF INVENTION

This invention generally relates to a lightweight roofing system that provides a safe, long lasting, leak-free and maintenance-free surface. More particularly, it is concerned with a fiberglass sandwich panel for use in a roofing system and a method for manufacturing a fiberglass sandwich panel that provides both structural strength and insulation and comprises a foam core, a gel coating and a fiberglass skin therebetween. Typical applications for the sandwich panel of the invention include flat and sloped roofs, building sidewalls, and paper machine dryer hoods.

BACKGROUND OF INVENTION

One conventional method of forming an insulated roof is to build-up a roof consisting of a concrete channel slab roof deck. Up to six layers, including insulation, membrane and stone ballast layers, are built-up on top of a concrete channel slab roof deck to form the insulated roof system. This type of roof system is complicated, difficult to install and to maintain, and has a large dead load (approximately 27 pounds per square foot) due to the combination of up to 7 layers. Each channel slab typically covers only a single structural purlin span. If one of the channel slab supports were to fail, the channel slab would fall inside the building. Further, concrete channel slabs are susceptible to corrosion, which can cause concrete in the roof deck to break apart and fall inside the building.

Other known methods of forming an insulated roof include joining together fiberglass sandwich panels. Conventional fiberglass sandwich panels employ the structure of a foam core sandwiched between outer fiberglass skins. One conventional method of forming such a panel is by blowing the foam into an air cavity between the fiberglass skins, then curing the panel. This process of foam-cavity blowing and curing may cause inadequate layer attachment and subsequent delamination problems. Another conventional method of forming roof panels is by pultrusion. Panels formed by this method are limited to the width of the pultrusion machine (typically two feet, but a maximum of four feet). In addition, pultrusion cannot completely encapsulate the foam core, leaving exposed the front and rear ends of the foam core.

The shape of the fiberglass sandwich panel determines how a plurality of the panels will fit together to form a roof. It is known in the art to make two rectangular panels and to put them together in overlapping and offset relation. Panels having this shape generally have highly stressed corners and have a tendency to come apart at the point where two halves are connected. Another conventional panel shape is a panel having a tongue on one end and a groove on the other end. The panels fit together by inserting the tongue of one panel into the groove of another. This shape is especially suited for siding and steep sloped roof applications rather than flat roof applications. When applied to flat roofs, leaks have formed where the panels are joined.

Fiberglass roof panels have been fabricated using a variety of other methods. As representative of such art, reference may be had to U.S. Pat. No. 3,841,958 to Delorme. The Delorme patent discloses forming a fiberglass sandwich roof panel on a continuous bed by sealing a foam layer to top and bottom face sheets made of glass cloth using sprayed layers of thermosetting or epoxy resin. Also disclosed are the forming of lengthwise ribs of resin bonded to the glass and foam layers by spraying resin into recesses in the surface of the foam core, and the forming of depthwise ribs through the foam core layer to connect the top and bottom skin layers.

U.S. Pat. Nos. 3,874,980 and 4,073,997 to Richards disclose roof panels having a top layer of randomly dispersed chopped strand filaments in 15%–25% resin in a lightweight mat, and a bottom layer of glass fibrous board of heavier density and thickness. Alternating layers of asphalt and glass fibrous mat are applied over the upper layer of an installation.

Roof panels formed by foaming a foam layer between facing sheets of metal foil to expand and impregnate a glass mat consisting of multiple layers of parallel glass fibers are disclosed in U.S. Pat. Nos. 4,028,158, 4,284,683 and 4,346,133 all to Hipchen. U.S. Pat. No. 4,438,166 to Gluck discloses the addition of flame retardant coatings to a panel made by the method disclosed in the Hipchen patents.

U.S. Pat. No. 4,279,958 to Ahmad discloses another fiberglass sandwich roof panel in which alternate layers of glass fibrous mat and woven or nonwoven webs of organic fibers (such as nylon, cellulose, or rayon) are applied at the upper layer. Another fiberglass roof panel is disclosed in U.S. Pat. No. 4,774,794 to Grieb. This roof panel is formed by hand lay-up to attach a fiberglass mat to the surfaces of a foam core (in standard four-foot widths) then applying a coating mixture of cement, fiberglass roving, and acrylic adhesive. The panels may be interconnected with tongue-and-groove joints sealed with adhesive, spline joints sealed with adhesive, and/or keyed joints sealed with a backer rod and cement.

Finally, U.S. Pat. Nos. 4,288,951 and 4,320,605 to Carlson are directed to insulated roof panels comprising polystyrene which are formed into multi-span widths having rabbeted ends. The panels are joined in ship-lapped relation to form panel joints at the panel ends, which are filled with a backer rod and sealant. The joined insulation panels are then covered with lapped layers of fiberglass topsheet.

Although many attempts have been made in the prior art to provide a roofing system comprising a plurality of fiberglass sandwich panels, none suggest the use of a sandwich panel having two substantially parallel surfaces and a peripheral edge having a step shape or a roofing system comprising sandwich panels having two shapes with relative dimensions joined at ship-lap joints. For example, the Grieb patent only mentions standard four foot width panels joined at tongue and groove joints. The patents to Carlson only disclose panels having rabbeted ends. Further, none of the above-described patents teach a process for forming fiberglass sandwich panels having multi-span widths by hand lay-up in a mold of layers comprising a gel coat layer, a fiberglass skin layer and a foam core.

The present invention is directed to a lightweight roofing system that provides a safe, long lasting, leak-free and maintenance-free surface for any application that requires both structural strength and insulation, in particular, flat roof applications. More particularly, it is concerned with an insulated fiberglass sandwich panel and a method for its manufacture. Another aspect of the invention is the provision of a system of overlapping sandwich panels, wherein the panels have preselected strength specifications for selected end uses. Other aspects of the invention reside in forming panels in widths that cover several purlin spans (i.e. multi-span widths) and the easy installation of the panels to form a continuous roof assembly having joints formed by lapping the panel ends with a backer rod and sealant. The sandwich panel of the invention installed in this manner will provide an insulated roof system that overcomes delamination problems of prior roof panels, has reduced dead load (approximately 3 pounds per square foot), easier installation and maintenance, and more reliable service use (i.e. no leaks).

Accordingly, it is a broad object of the invention to provide an improved insulated roofing system for flat roof applications.

A more specific object of the invention is to provide a roofing system that provides a safe, long lasting, leak-free and maintenance-free insulated surface.

Another object of the invention is to provide a fiberglass sandwich panel for use in the insulated roofing system that is easy to install and will not delaminate.

SUMMARY OF THE INVENTION

In the present invention, these purposes, as well as others which will be apparent, are achieved generally by providing a layered sandwich panel having a bottom gel coat, a bottom fiberglass skin, a preformed foam layer, a top fiberglass skin, and a top gel coat. The panel shape comprises two substantially parallel surfaces and a peripheral edge having a step on one of said surfaces.

According to the preferred process, the insulated fiberglass sandwich panel of the invention is fabricated by hand lay-up of a plurality of layers of a gel coating, a fiberglass skin and foam core in a mold. A gel coating is applied to the interior cut-out surface of the mold. Before the gel coating has completely cured, a bottom fiberglass skin is applied thereto. Before the bottom skin has fully cured, a preformed foam core is applied thereto and a top fiberglass skin is applied on top of the foam. Before the top skin has fully cured, a top gel coating is applied thereto and all layers are cured.

The invention improves upon known fiberglass roof panels by having the fiberglass skin cure while in contact with the foam core to ensure a good bond between the fiberglass skin and the foam core. Further, the technique for forming the panel is simple and may be performed with a minimum amount of special equipment, allowing for easy fabrication of a high quality fiberglass sandwich panel.

For increased rigidity in the panel, lengthwise interior ribs may be inserted into the fiberglass skin layers. Further, depthwise ribs can be formed through the foam core layer connecting the fiberglass skin layers to improve the shear modulus and shear strength of the foam core. Other alternatives for increasing the panel stiffness include, but are not limited to, increasing the thickness of the foam core or fiberglass skin thickness and using a skin that has a higher tensile modulus/strength in the lengthwise direction.

A plurality of the fiberglass sandwich panels having two shapes (or sizes) with relative dimensions are joined together to form the roofing system of the invention. The panels are arranged to cover and attach to a plurality of structural steel purlins in alternating fashion such that four panel corners will never be brought together at one point. The panels are joined at lap joints with backer and sealant to provide a leak-free and insulated roof that is easy to install and maintain.

Other objects, features and advantages of the present invention will be apparent when the detailed description of the preferred embodiments of the invention are considered in conjunction with the drawings which should be construed in an illustrative and not limiting sense as follows.

DESCRIPTION OF PREFERRED EMBODIMENT

Figure 1A:
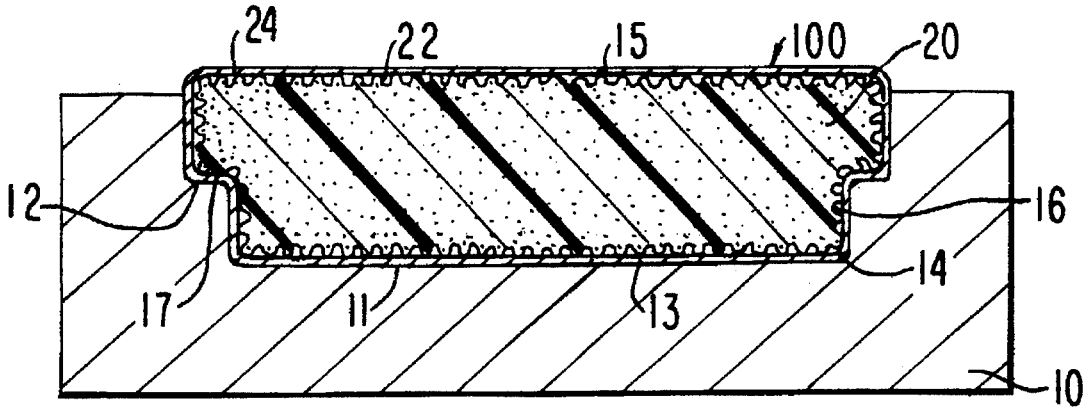
FIG. 1A is a cross-sectional view of a mold for forming the fiberglass sandwich panel of the present invention taken along the line 1—1 of FIG. 1B.
Figure 1B:
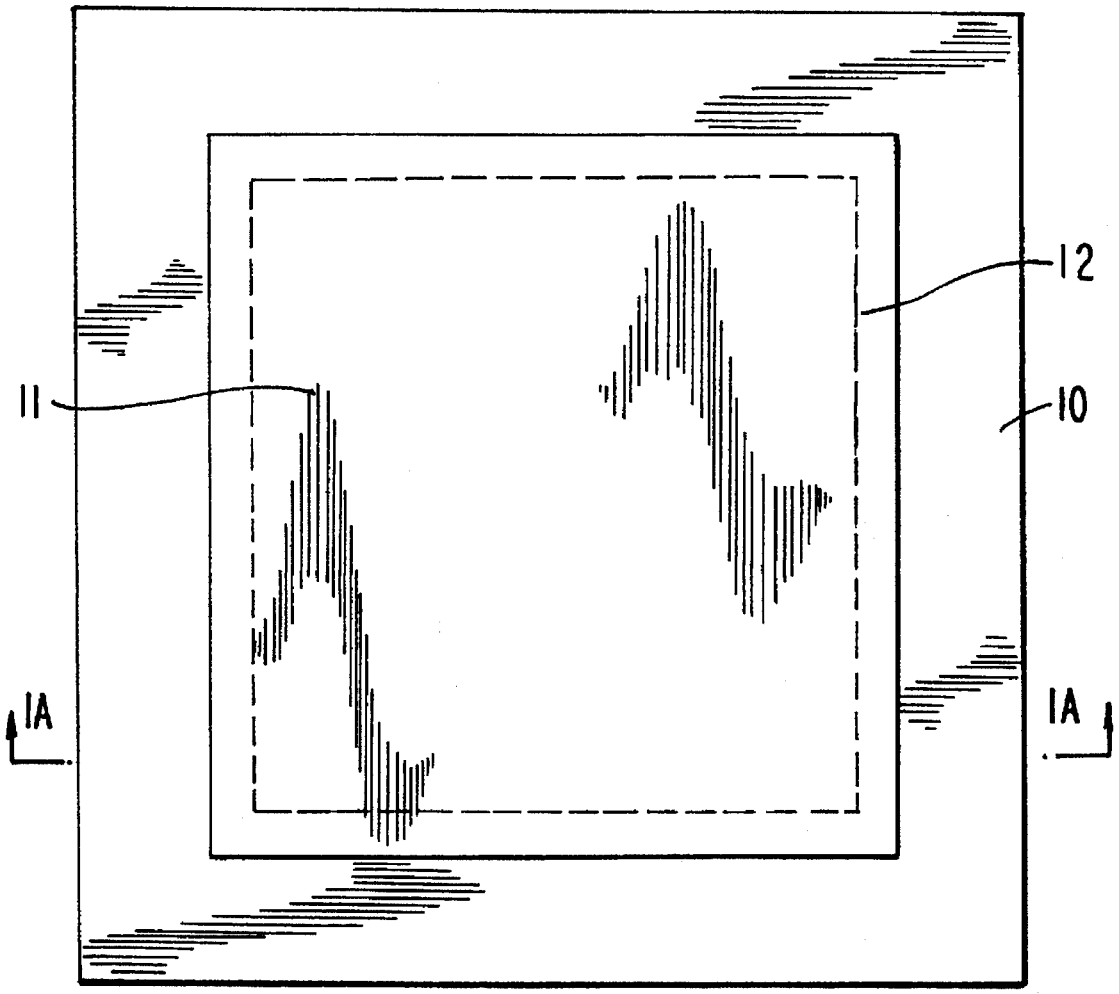
FIG. 1B is a top view of a mold for forming the fiberglass sandwich panel of the present invention.

With further reference to the drawings, FIGS. 1A and 1B show a mold 10 for forming the fiberglass sandwich panel 100 in accordance with the invention. A mold 10 is provided having an interior cut-out section, or cavity, comprising a bottom surface 11 and stepped sides 12 around the entire interior cut-out section. A complete sandwich panel will be formed in the mold's cavity. The mold must be stiff and must have a smooth finish on its surface. Further, all corners around the interior cut-out section should be radiused, preferably to a ⅜ inch radius. This allows for effective laying up in the corners of the mold and eliminates sharp edges on the sandwich panel. The shape of the mold's interior section ensures that the sandwich panel 100 will have substantially parallel surfaces 13 and 15 and peripheral edges having a step (or notch) 17 therein.

The fiberglass sandwich panel 100 of the invention and a process for fabricating such a panel will be described with particular reference to FIG. 1A. In accordance with the invention, a bottom gel coat resin 14 is applied to the bottom surface 11 and stepped sides 12 of the mold's 10 empty interior cut-out section to a thickness of 7–12 mils, preferably 8 mils. The gel coating is provided to protect the fiberglass skins from corrosion, including ultraviolet degradation, and to improve the visual appearance of the panel surface. Therefore, preferred gel coatings should be ultraviolet resistant, weather resistant and chemically resistant. The gel coating may be, for example, a specially formulated polyester resin or equivalent. A suitable gel coat is commercially available from Cook Composites, Kansas City, Mo., under the tradename WHITE-CODE FR 10,000, which provides a smooth, white surface to the sandwich panel.

Before the bottom gel coating 14 has completely cured (i.e. the coating is still tacky), a bottom fiberglass skin 16 is applied to the tacky exterior surface of the gel coating 14 to a thickness of at least 75 mils, preferably 80 mils. The bottom skin 16 is preferably applied by a hand lay-up process and consists of a single biaxial mat comprising 55% vinyl ester resin and 45% glass or equivalent. A suitable biaxial mat is commercially available from Tech Textiles, Phenix City, Ala., under the tradename E-LIMP 3610, style 2542. The 3610 biaxial mat consists of 18 oz/yd$^2$ of unidirectional glass fibers stitched to 18 oz/yd$^2$ of unidirectional glass fibers in the perpendicular direction stitched to 1.0 oz/ft$^2$ of chopped strand mat. The chopped strand mat side faces the outside of the panel. The hand lay-up process consists of placing the 3610 biaxial mat onto the partially cured gel coat 14. The mat is then saturated with catalyzed resin by pouring resin onto the glass mat and working the resin into the mat with rollers.

Before the bottom skin 16 has fully cured, a preformed, closed cell, urethane foam core 20 having a thickness of at least 3.0 inches is layed on top of the tacky exterior surface of the bottom skin 16. Urethane is advantageous because of its strength and economic efficiency. A suitable foam core is the WEBCORE-IB 150 foam or equivalent, which comprises 2 lb/ft$^3$ isocyanurate foam (closed cell) with fiberglass reinforcing webs. There is approximately 1.5 inches between each web.

Figure 2A:
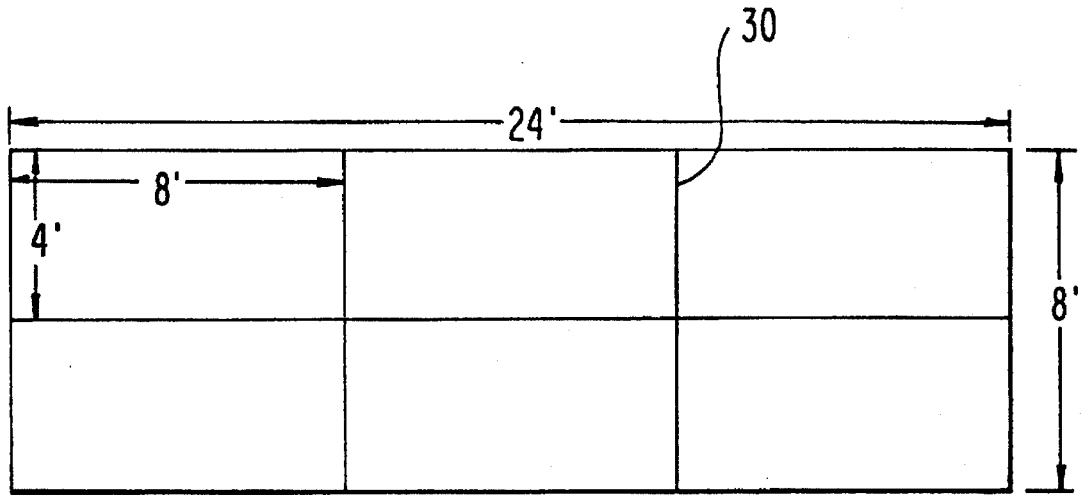
FIG. 2A is a top view of a mold for forming the fiberglass sandwich panel of the invention having 8'×4' preformed foam cores correctly inserted therein.
Figure 2B:
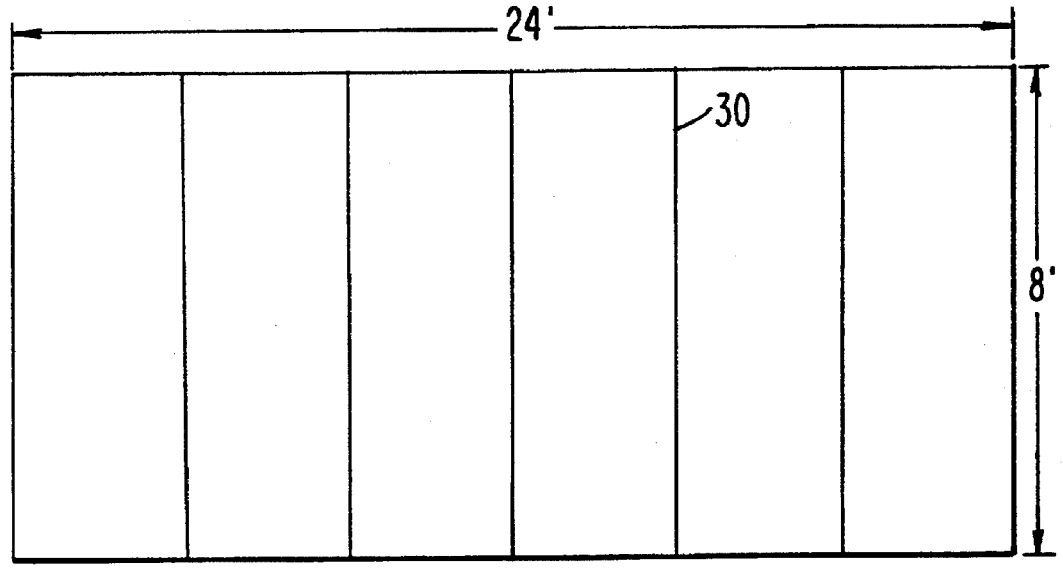
FIG. 2B is a top view of a mold for forming the fiberglass sandwich panel of the invention having 8'×4' preformed foam cores incorrectly inserted therein.

The foam core 20 is typically 8 feet by 4 feet and must be preformed, preferably into the shape of the interior cut-out section of the mold 10. When making a panel 100 having dimensions greater than 8 feet by 4 feet, the foam blocks 20 should be oriented in the mold 10 as shown in FIG. 2A. For example, to make a 24 foot by 8 foot sandwich panel, six foam blocks 20 are used. Resin filling 30 between the foam blocks 20 will increase the strength of the panel in the lengthwise direction. If the foam blocks 20 are arranged vertically next to each other in the mold 10 as shown in FIG. 2B, an increase in strength in the lengthwise direction does not occur.

A top fiberglass skin 22 is then applied by the hand lay-up process in a manner similar to the hand lay-up of the bottom skin 16 to a thickness of 80 mil. Before the top skin 22 is fully cured, a top gel coating 24 is applied to the tacky outer surface of the top skin 22 to a thickness of 8 mil to complete the layered structure. The sandwich panel 100 is then allowed to cure in the mold 10 for the resin supplier's recommended cure time. Curing is effected by adding a catalyst to the resin just prior to hand lay-up of each layer. The catalyst reacts with the resin and "cures" it at room temperature. Generally, it takes about 20–30 minutes before the resin begins to cure and harden.

Figure 3:
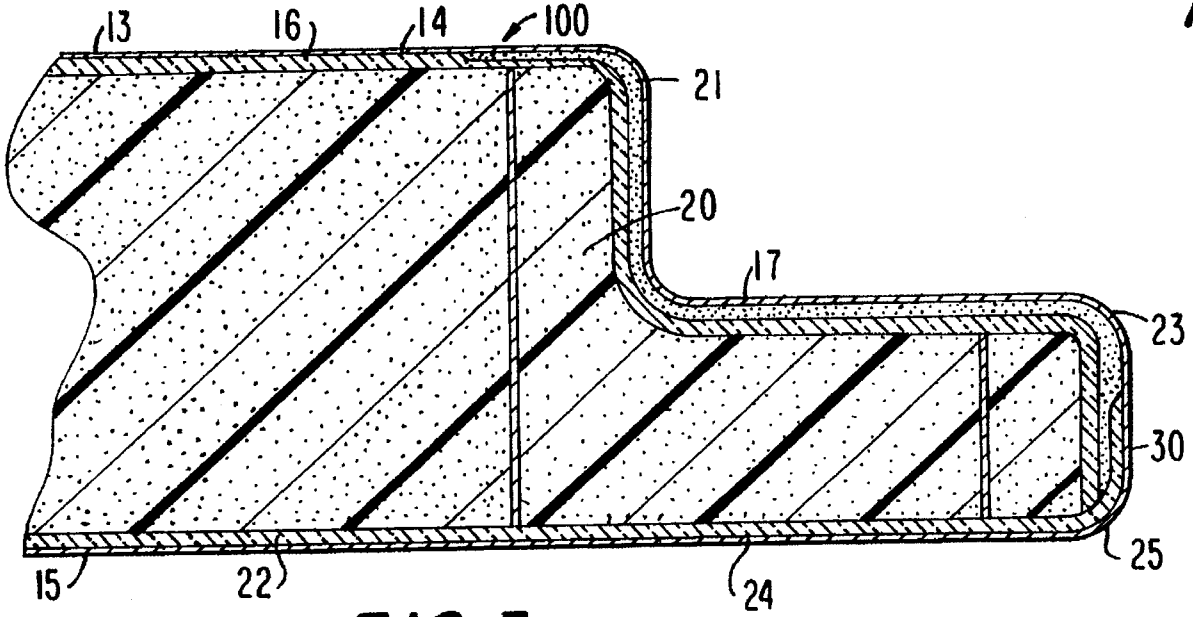
FIG. 3 is a partial cross-sectional view of a fiberglass sandwich panel in accordance with the invention.

As shown in FIG. 3, the sandwich panel 100 has rounded edges to eliminate any sharp corners. The bottom edge 21 and step edge 23 of the panel 100 are rounded by shape of the mold's 10 interior cut-out section. The top edge 25 is rounded after the panel 100 is removed from the mold. It is critical that the bottom and step edges, 21 and 23 respectively, be rounded because the bottom fiberglass skin 16 can be effectively hand layed-up only into rounded corners (i.e. and not sharp corners).

The preferred process for manufacturing the sandwich panel 100 has produced a sandwich panel having numerous advantages. The panel strength and integrity are improved by curing the fiberglass skin directly to the preformed foam core. The panel stiffness is maximized because the skin is securely bonded to the foam core during the fabrication process. In other words, the skin cannot slip past the foam core and reduce panel stiffness. In addition, using a fully cured preformed foam core and bonding the skin directly to the foam core during fabrication ensures that no voids or internal pressure can form inside the panel which may result in the skin delaminating from the foam core. The foam core is fully encapsulated by the skin during the fabrication process. The gel coating 14, 24 also provides sufficient protection from ultraviolet light. The fully cured foam core 18, 20 provides the panel 100 with insulation. Further advantage is obtained by the easy and economical process for manufacturing a sandwich panel that will not require any special technology or equipment such as foam blowing or pultrusion equipment as in the prior art. Accordingly, all fiberglass shops will be able to fabricate the sandwich panel in accordance with the present invention.

It will be realized that the sandwich panel of the invention can be fabricated by other methods, including automated methods, provided the foam core can be completely encapsulated by the fiberglass and gel coating layers. One such method of manufacturing the sandwich panel employs the use of an impregnator. In this method, the fiberglass mats are dipped into a bucket of resin and pulled through a series of rollers. The rollers squeeze excess resin out of the fiberglass mats and pull the fiberglass mats into the mold. Although this method provides a faster, more consistent method than fabricating each panel by hand, it requires additional expense.

The preferred shape of the sandwich panel has several advantages. The fiberglass skins can easily conform to the mold shape. In addition, one continuous fiberglass skin can be used to join the panel top, side wall and bottom, thus increasing the panel strength. To do this, a fiberglass skin of suitable length to surround the foam core is applied to the mold so that it hangs over the top edges of the mold 10, the foam core is placed in, and the skin is then flipped on top of the foam core and spliced together. No other known fiberglass sandwich panel or foam core panel has this preferred shape.

Figure 10:
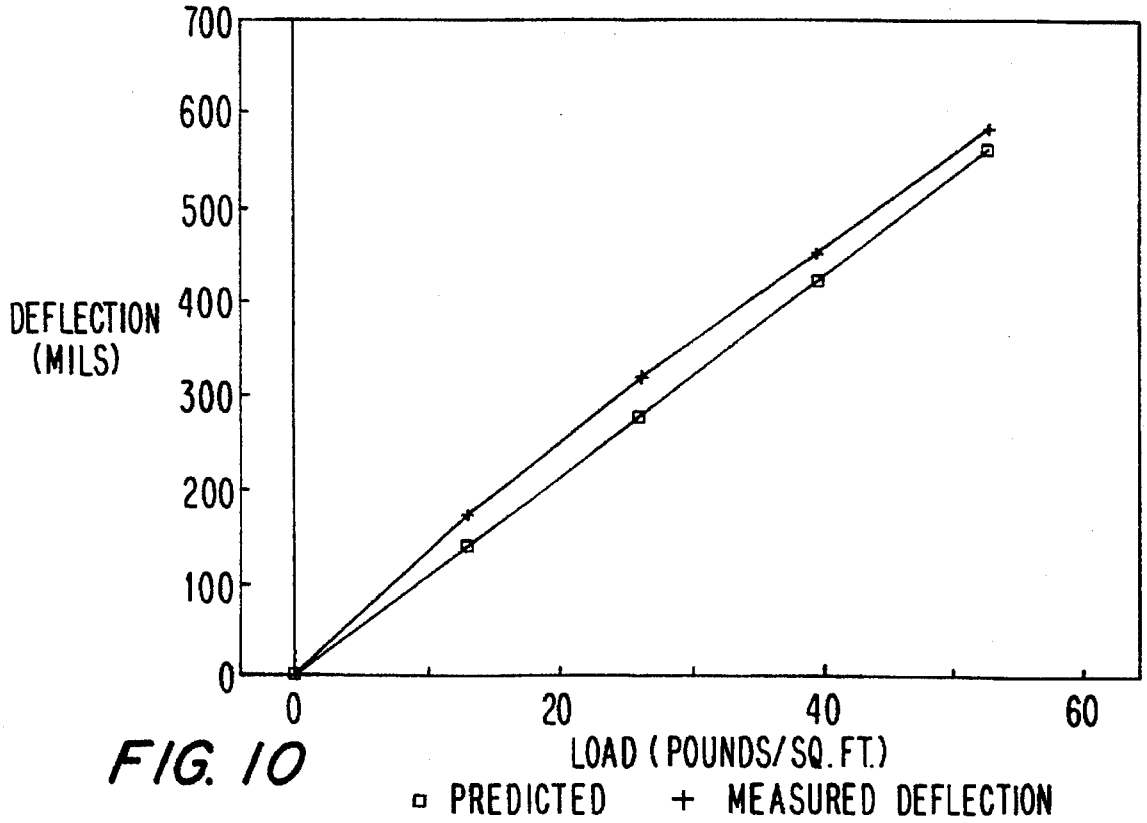
FIG. 10 is a graph showing panel deflection versus uniform load of a sandwich panel in accordance with the invention.

The strength of the sandwich panel of the invention may be accurately engineered based on the individual strengths and thickness of the foam core and fiberglass skins. FIG. 10 illustrates that the stiffness (or deflection) of the fiberglass sandwich panel of the invention follows accepted engineering calculations. In FIG. 10, the measured midpoint deflection of a simply supported panel with a uniform load is compared with engineering calculations. The predicted midpoint deflection ($\Delta X$) for a uniform load on a simple span is given below as the sum the midpoint deflection from the skins and from the core:

$$\Delta X_{TOTAL}=\Delta X_{skins}+\Delta X_{core}$$

$$\Delta X_{skins}=5qL^4/384EI$$

$$\Delta X_{core}=qL^2/8GA$$

$$I=\tfrac{2}{3}b[(T/2+t)^3-(T/2)^3]$$

where:

| | |
|---|---|
| L = span length | A = panel cross sectional area |
| q = total load per span | b = panel width |
| E = skin tensile modulus | T = foam thickness |
| I = moment of inertia | t = skin thickness |
| G = foam shear modulus | |

For the panel shown in FIG. 10, the following measurements were used:

| | |
|---|---|
| L = 7 feet | G = $1 \times 10^3$ psi |
| E = $1.5 \times 10^6$ psi | A = 37.8 square inches |
| T = 3 inch | b = 12 inches |
| t = 0.075 inch | |

The panel performance for other conditions (i.e. point loads, panel ends tied down) may be accurately predicted by using the appropriate engineering calculations.

One combination of fiberglass skin and foam core that will meet the performance shown in FIG. 10 is summarized below. The fiberglass skin has a minimum tensile modulus in the lengthwise direction of $1.5\times10^6$ psi and a minimum thickness of 0.075 inch. The foam core has a minimum shear modulus of 1000 psi and a minimum thickness of 3 inches. Other combinations of fiberglass skins and foam core may be determined using the general equations given above.

Figure 11:
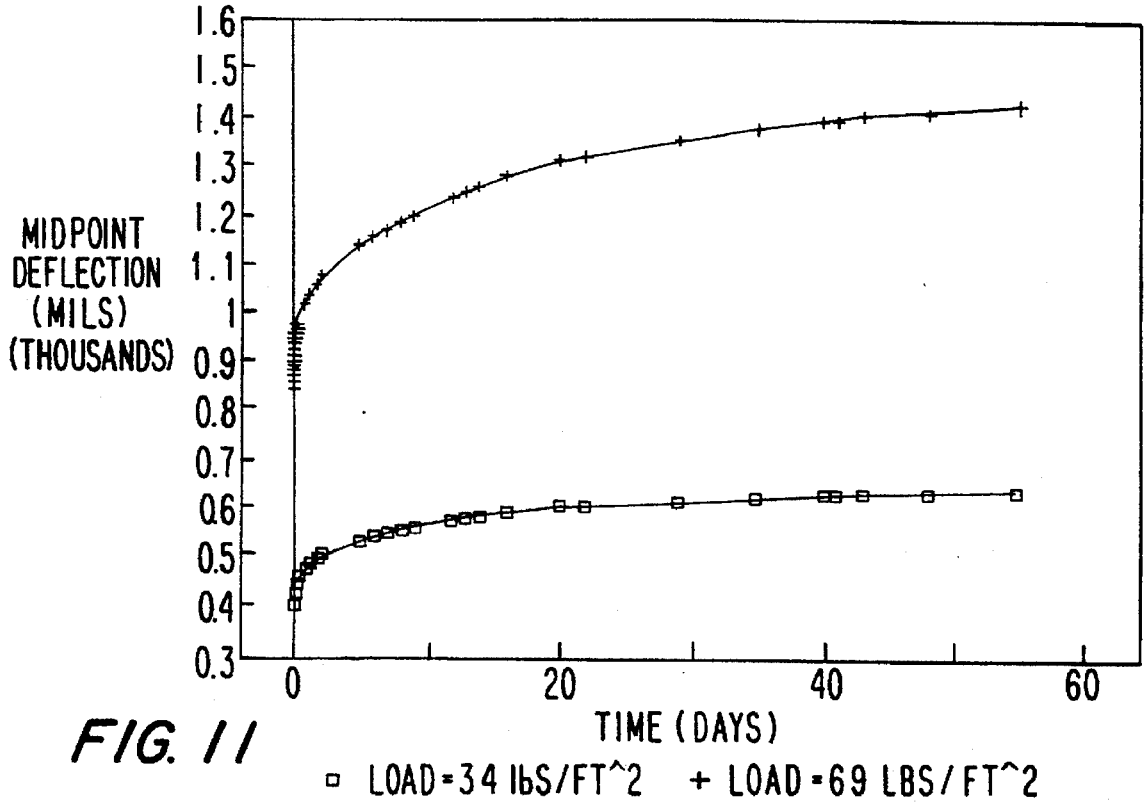
FIG. 11 is a graph showing midpoint deflection of a sandwich panel in accordance with the invention versus time for uniform load.
Figure 12:
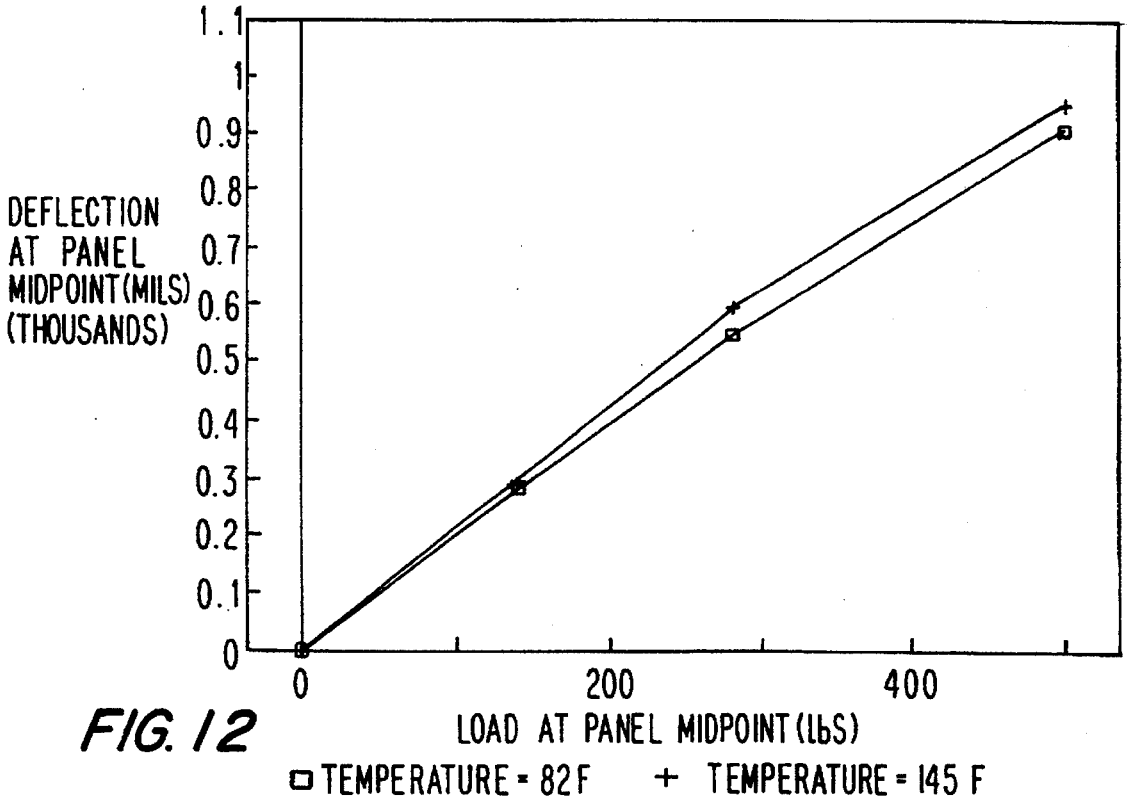
FIG. 12 is a graph showing midpoint deflection versus midpoint load at two temperatures evidencing the effect of temperature on panel strength.

The creep characteristics for a 7-foot sandwich panel are summarized in FIG. 11. This graph shows the panel's midpoint deflection resulting from a uniform load over a period of time. FIG. 12 shows that the panel stiffness is not affected by temperatures up to 145° F.

Figure 13:
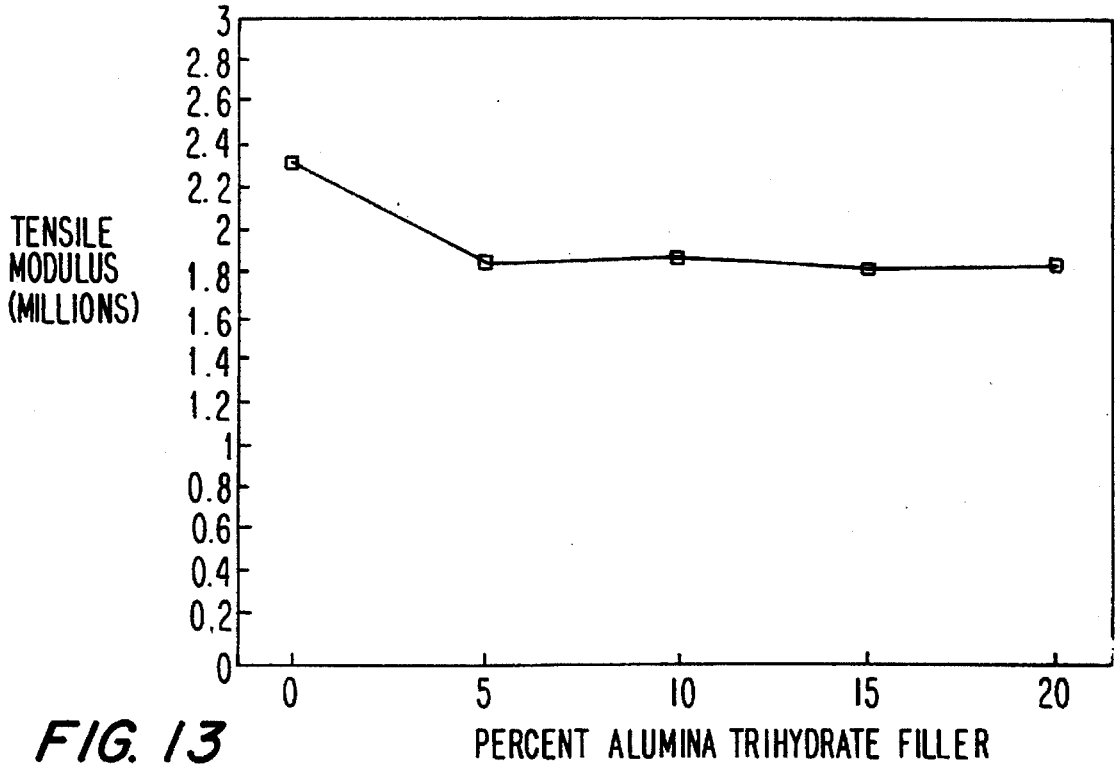
FIG. 13 is a graph showing tensile modulus of a fiberglass coupon similar in composition to the fiberglass skin of the sandwich panel in accordance with the invention versus percent of alumina trihydrate filler therein.

Fire retardation requirements for a flat roofing system are met by adding a sufficient fire retardant to the fiberglass skin resins 16, 22. A suitable resin is a brominated resin with addition of approximately 5% antimony trioxide and a sufficient amount, approximately 20%, of aluminum trihydrate filler. FIG. 13 shows that up to 20% of aluminum trihydrate may be added to the skin resin without affecting the tensile modulus of the skin.

Figure 4:
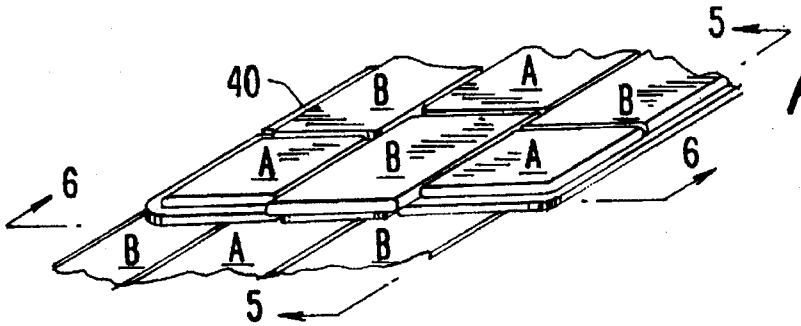
FIG. 4 is an isometric sketch showing an elevational view of an insulated roofing system in accordance with the invention.
Figure 5:
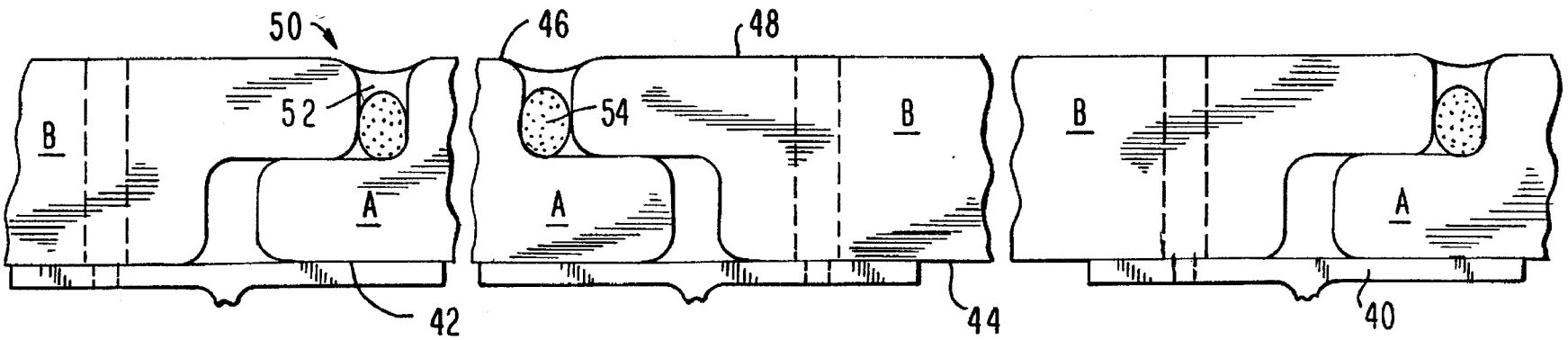
FIG. 5 is a cross-sectional view of the insulated roofing system taken along the line 5—5 of FIG. 4.
Figure 6:
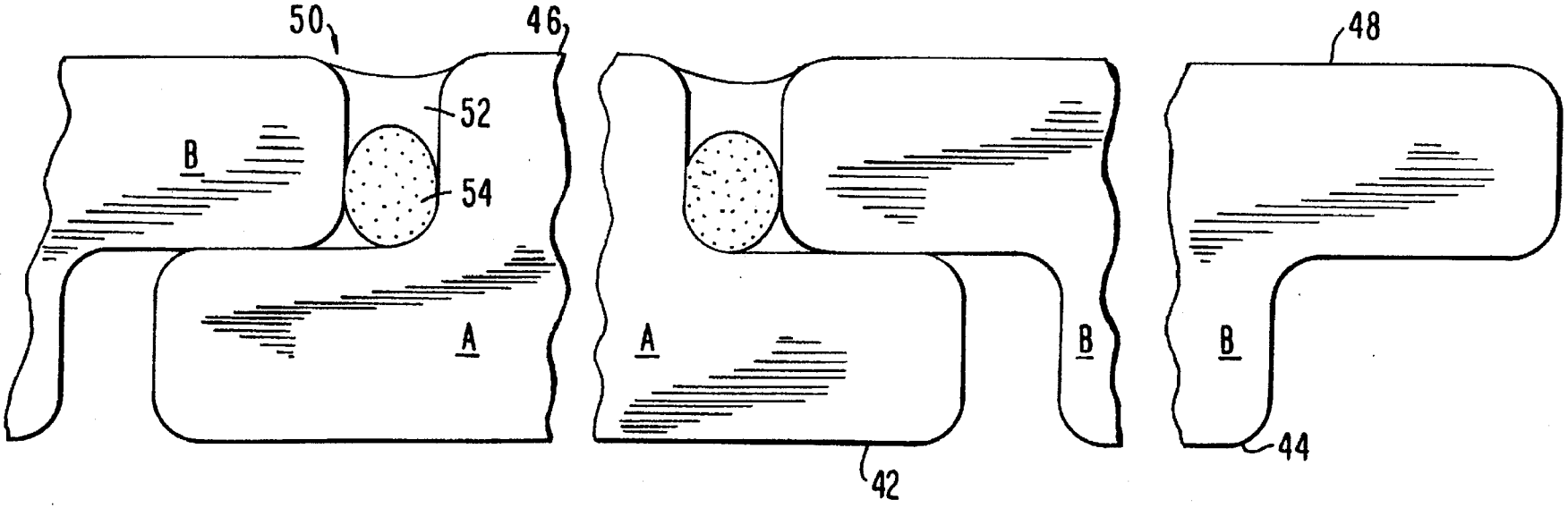
FIG. 6 is a cross-sectional view of the insulated roofing system taken along the line 6—6 of FIG. 4.

With reference to FIGS. 4–6, a plurality of sandwich panels 100 are attached and assembled to structural steel purlins 40 to form a continuous, safe, leak-free, long-lasting, and maintenance-free insulated roofing system. In accordance with the invention, the roofing system comprises sandwich panels as described above having two different shapes (an "A" shape and a "B" shape). Referring to FIGS. 5 and 6, each of the "A" and "B" panels have a lower inner side 42, 44, respectively, for attachment to a steel purlin 40, and an outer side 46, 48, respectively. In a preferred embodiment, the dimensions of each side are as follows:

| | "A" Panel | "B" Panel |
|---|---|---|
| Width of Inner side | 8 ft. | 7 ft., 3 in. |
| Width of Outer side | 7 ft., 7½ in. | 7 ft., 7½ in. |
| Length of Inner side | 23 ft., 11¼ in. | 23 ft. 11¼ in |
| Length of Outer side | 23 ft. 6¾ in. | 24 ft. 3¾ in. |

The thickness or height of both the "A" and the "B" panels is 3 feet, 3/16 inches. It is essential that the "A" and "B" panels have relative dimensions so that they fit together. The panels will fit together only when the "A" panel is four times the ship lap Width (i.e., 4×2.25"=9") wider than the "B" panel on the inner side 42, 44 and the "B" panel is four times the ship lap width longer than the "A" panel on the outer side 46, 48. The widths of the outer sides 46, 48 and the lengths of the inner sides of each panel must be identical.

When assembling the roof system, the sandwich panels are brought together at overlapping joints 50. It is essential to the invention that the panels do not interlock. Rather, the notches (or steps) in each panel's sides clamp onto the seals in the joints to ensure a water tight assembly. This also provides easy installation and maintenance of the panels. The preferred joint for bringing the panels together is a well known ship lap joint having an expansion gap 52 with a backer rod 54 therein. The joint allows the panels to move ±50% of the joint width while not allowing water to penetrate the roof. The expansion gap 52 is preferably 0.75 inch wide and filled with a sealant to protect against leaks. Sealants are most effective when they contain silicone or an equivalent thereof. A preferred sealant is the DOW 795 silicone sealant manufactured by the Dow Corning, Midland, Mich. The sealant should have a minimum expansion/contraction of ±50% of the joint width. The silicone sealant should not be applied when surface temperatures exceed 120° F. or when surfaces are wet. The backer rod 54 comprises a 1-inch diameter polyurethane, closed cell foam and provides the silicone the optimum width to depth ratio of 2 to 1.

Prior to application of the silicone sealant, all joints must be cleaned to remove all contaminants such as grease, oil, dirt and dust. If necessary, the joints can be blown out with oil-free air. The joints should be wiped with a solvent such as one comprising 50% isopropyl alcohol and 50% water. Apply the solvent by wiping it on and off with an oil and lint-free cloths and allow it to dry.

The panels are arranged on structural steel purlins 40 in an alternating panel matrix to form a substantially continuous roof such that each "A" panel is surrounded along its horizontal and vertical edges by only "B" panels, and each "B" panel is surrounded along its horizontal and vertical edges by "A" panels. See FIGS. 7 and 8. Side joints 53 are formed by the intersection of side edge sections on the peripheral edge of the panel. When assembled, the side joints 53 between said "A" and "B" panels are offset in the panel matrix. This assembly ensures that no more than three panels come together at any of points 51 in the roof system (as opposed to the conventional four panel joint), allowing a better joint to form and to reduce the probability of water leakage. Advantageously, this alternating assembly of panels that are not interlocked allows half of the panels (e.g. all of the "B" panels) to be removed without affecting the remaining panels of the roof (i.e. the "A" panels). If it is necessary to remove an "A" panel, the four surrounding "B" panels can first be easily removed. Then, the "A" panel can be removed. All outside edges of the completed roofing system should have straight edges (i.e. no ship-lap joints).

Figure 9:
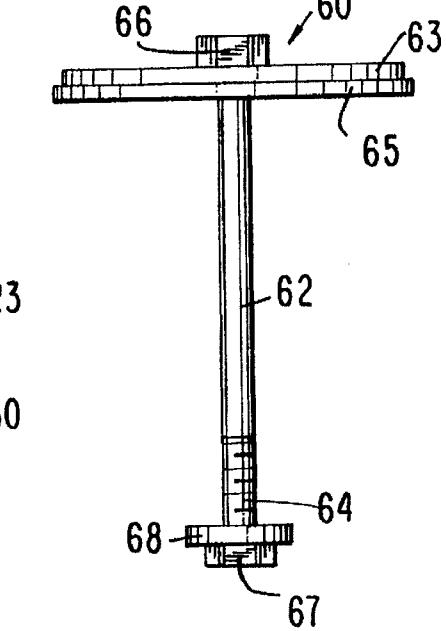
FIG. 9 is a perspective view of the means for fastening the sandwich panel to a purlin span in accordance with the invention.

The panels are attached to the steel purlins 40 by stainless steel fasteners 60 as shown in FIG. 9. Preferred structural purlins have a 6½ inch wide top flange. Preferred fasteners 60 include a 4.5 inch bolt 62 having a diameter of 0.25 inch and threads 64 at the end opposite the head 66. Each bolt 62 passes through a washer 63 and neoprene gasket 65 and penetrates the outer surface of the panels at fastener points 70 adjacent to joints 50. See FIG. 7. The bolt 62 then passes through a hole in purlin 40. A 0.25 inch locknut 67 and a 0.25 inch washer 68 are screwed on the threads 64 to tighten the assembly. The bolt 62 preferably should be torqued to 3 foot-pounds±½ foot-pound.

Figure 7:
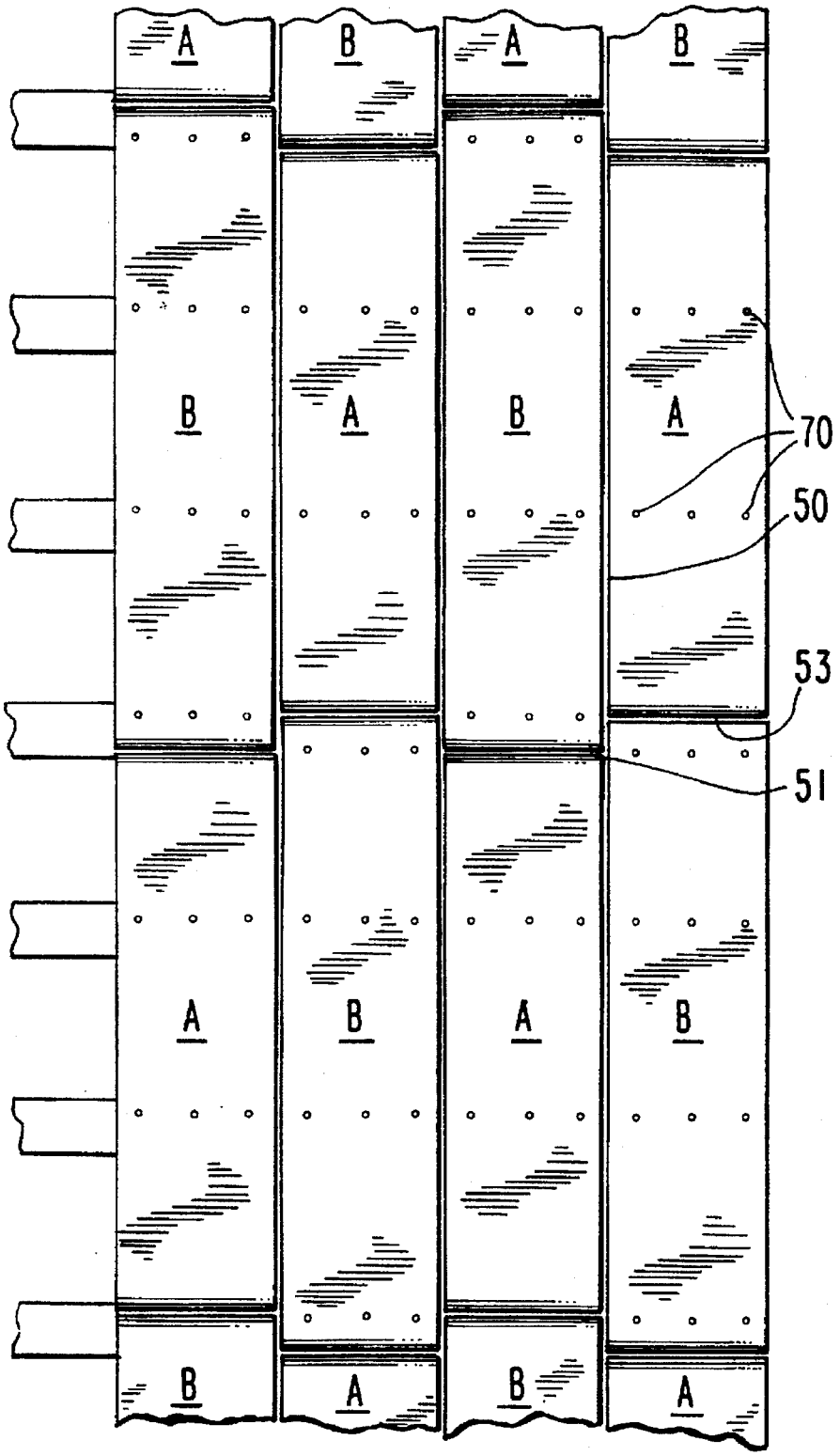
FIG. 7 is a top plan view of an insulated roofing system in accordance with the invention.
Figure 8:
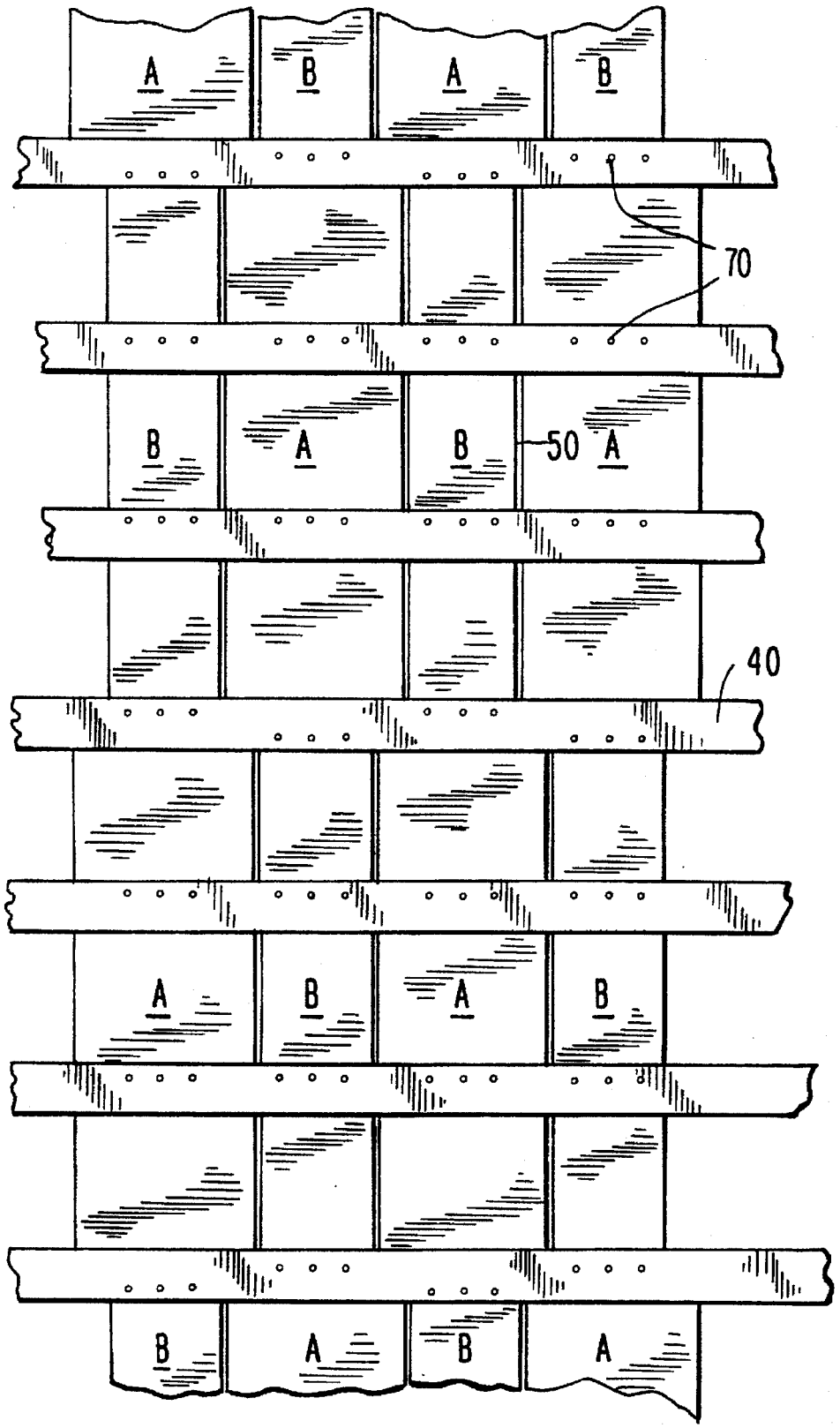
FIG. 8 is a bottom plan view of an insulated roofing system in accordance with the invention.

It has been found that using fasteners (e.g. bolts or self-tapping screws) to penetrate the panel joints 50 increases the possibility for leaks through the joint 50. Therefore, it is essential that fasteners 60 do not penetrate the panel joints 50, but rather penetrate through the face of the panel at a plurality of points 70 that correspond with the purlins 40 as shown in FIG. 7. Fastener points 70 are generally adjacent to joints 50 and have the same fastening effect as fasteners penetrating a joint because the panels are overlapping.

From the foregoing, it will be appreciated that the present invention provides an insulated roof system comprising a plurality of alternating panels having two different shapes with relative dimensions. In particular, advantage is obtained by providing a sandwich panel which comprises a foam core that is fully encapsulated by a fiberglass skin, which has a gel coating on its outer surface and is formed by hand lay-up of the layers before the prior layers have completely cured. Further advantage is obtained by assembling the panels with a ship lap joint and fasteners which penetrate the face of each panel to secure the panels to steel structural purlins. Therefore, a leak-free roof system that is safe, easy to install and maintain, has long life expectancy (i.e. more than 30 years), and has reduced dead load is provided by the invention.

Although the invention has been described with reference to preferred embodiments, it will be appreciated by one of ordinary skill in the art of fiberglass sandwich panels that numerous modifications are possible in light of the above disclosure. For example, the dimensions and compositions of the individual sandwich panels can be adjusted depending on the size of the roof and the span length between purlins and the required panel stiffness. All such variations and modifications are intended to be within the scope and spirit of the invention as defined in the claims appended hereto.

We claim:

1. An insulated and corrosion resistant sandwich panel having a length greater than 8 feet and a width greater than 4 feet, which comprises a foam core having a plurality of depthwise fiberglass ribs extending therethrough, a fiberglass skin fully encapsulating and cured in integral contact with said core, and a gel coating fully encapsulating said skin;

wherein said foam core comprises a plurality of preformed foam blocks each having a length of 8 feet and a width of 4 feet and a resin filling inserted between each of said blocks, said blocks being arranged such that said length of said blocks is oriented with said length of the panel;

wherein the panel has a first surface and a second surface substantially parallel thereto and a peripheral edge having a step therein, said ribs connecting said fiberglass skin on said first surface to said fiberglass skin on said second surface.

2. A sandwich panel according to claim 1, wherein said step in said peripheral edge has four edges, each of said edges being rounded to eliminate any sharp corners.

3. A sandwich panel according to claim 2, wherein each of said edges is rounded to a ⅜ inch radius.

4. A sandwich panel according to claim 2, wherein said fiberglass skin comprises one continuous biaxial mat of suitable length to surround said foam core.

5. A sandwich panel according to claim 4, wherein said biaxial mat comprises vinyl ester resin and glass.

6. A sandwich panel according to claim 5, wherein said biaxial mat comprises a first layer of unidirectional glass fibers sandwiched by a chopped strand mat and a second layer of unidirectional glass fibers oriented perpendicular to said first layer, said second layer of glass fibers contacting said foam core.

7. A sandwich panel according to claim 6, wherein said fiberglass skin has a thickness of at least 75 mils and a minimum tensile modulus in the lengthwise direction of $1.5\times10^6$ psi.

8. A sandwich panel according to claim 4, wherein said foam core comprises a fully cured, closed cell, urethane foam.

9. A sandwich panel according to claim 8, wherein said foam core has a thickness of at least 3 inches.

10. A sandwich panel according to claim 9, wherein said foam core has a minimum shear modulus of 1000 psi.

11. A sandwich panel according to claim 8, further comprising a fire retardant added to said skin and to said gel coating.

12. A sandwich panel according to claim 8, wherein temperatures up to 145° F. do not affect the stiffness of the panel.

13. A sandwich panel according to claim 8, wherein said gel coating comprises polyester and has a thickness of 7–12 mils.

14. A sandwich panel according to claim 13, wherein the panel has a weight of 3 pounds per square foot.

* * * * *